US011197590B2

(12) United States Patent
Miura

(10) Patent No.: US 11,197,590 B2
(45) Date of Patent: Dec. 14, 2021

(54) WET SHEET STORAGE CONTAINER

(71) Applicant: DAIO PAPER CORPORATION, Ehime (JP)

(72) Inventor: Akiteru Miura, Ehime (JP)

(73) Assignee: DAIO PAPER CORPORATION, Ehime (JP)

( * ) Notice: Subject to any disclaimer, the term of this patent is extended or adjusted under 35 U.S.C. 154(b) by 435 days.

(21) Appl. No.: 16/332,396

(22) PCT Filed: May 23, 2017

(86) PCT No.: PCT/JP2017/019099
§ 371 (c)(1),
(2) Date: Mar. 12, 2019

(87) PCT Pub. No.: WO2018/061304
PCT Pub. Date: Apr. 5, 2018

(65) Prior Publication Data

US 2021/0282605 A1 Sep. 16, 2021

(30) Foreign Application Priority Data

Sep. 30, 2016 (JP) ..... JP2016-192477

(51) Int. Cl.
*B65D 83/08* (2006.01)
*A47K 10/38* (2006.01)
(Continued)

(52) U.S. Cl.
CPC ..... *A47K 10/3818* (2013.01); *B65D 43/0231* (2013.01); *B65D 51/18* (2013.01);
(Continued)

(58) Field of Classification Search
CPC .. A47K 10/3818; A47K 10/44; A47K 10/421; A47K 2010/3266;
(Continued)

(56) References Cited

U.S. PATENT DOCUMENTS

2002/0166834 A1* 11/2002 Branson ..... B65D 50/046 215/216

FOREIGN PATENT DOCUMENTS

CN 1478038 A 2/2004
CN 1894139 A 1/2007
(Continued)

OTHER PUBLICATIONS

Supplementary European Search Report and European Search Opinion dated Sep. 10, 2019 of corresponding application No. EP17855263; 7 pgs.
(Continued)

*Primary Examiner* — King M Chu
(74) *Attorney, Agent, or Firm* — Maier & Maier, PLLC

(57) ABSTRACT

A wet sheet storage container. A plurality of male thread parts for screwing a lid body in the circumferential direction are formed on the outer circumferential surface of an upper end part of a container body, and a plurality of female thread parts for threadedly engaging with the male thread parts are formed on the inner circumferential surface of the lid body. The male thread parts are each provided with a base end part formed on the upstream side in the rotation direction of the lid body during installation of the lid body, and a tip end part formed on the downstream side in the rotation direction of the lid body, and the male thread parts are formed such that the height of the tip end part is greater than the height of the base end part.

4 Claims, 5 Drawing Sheets

(51) Int. Cl.
*B65D 43/02* (2006.01)
*B65D 51/18* (2006.01)
*A47K 10/32* (2006.01)

(52) U.S. Cl.
CPC .. *B65D 83/0894* (2013.01); *A47K 2010/3233* (2013.01); *A47K 2010/3266* (2013.01); *B65D 2251/0021* (2013.01); *B65D 2251/0081* (2013.01); *B65D 2543/00092* (2013.01); *B65D 2543/00527* (2013.01); *B65D 2543/00537* (2013.01)

(58) Field of Classification Search
CPC ..... A47K 2010/3233; B65D 43/0231; B65D 83/0894; B65D 2251/0021; B65D 2251/0081
USPC ..... 221/45, 63; 206/407
See application file for complete search history.

(56) References Cited

FOREIGN PATENT DOCUMENTS

| | | | |
|---|---|---|---|
| CN | 203306404 | U | 11/2013 |
| EP | 0366198 | A1 | 5/1990 |
| JP | H063852 | U | 1/1994 |
| JP | 3621920 | B2 | 2/2005 |
| JP | 2008007130 | A | 1/2008 |
| JP | 2010241464 | A | 10/2010 |
| JP | 2011051640 | A | 3/2011 |
| JP | 2011131913 | A | 7/2011 |
| JP | 2012096817 | A | 5/2012 |
| JP | 2012250763 | A | 12/2012 |
| JP | 2015160654 | A | 9/2015 |
| WO | 2011108134 | A1 | 9/2011 |

OTHER PUBLICATIONS

Chinese Office Action dated Apr. 9, 2020 of corresponding application No. 201780054251; 12 pgs.
Japanese Office Action dated Jun. 20, 2017 of corresponding application No. 2016192477; 6 pgs.
Decision to Grant a Patent dated Jul. 18, 2017 of corresponding application No. 2016192477; 5 pgs.
International Search Report dated Jul. 11, 2017 and Written Opinion of corresponding application No. PCT/JP2017/019099; 6 pgs.

* cited by examiner

WET SHEET STORAGE CONTAINER

FIELD

The present invention relates to a wet sheet storage container which stores a wet sheet.

BACKGROUND

In the related art, as a hygienic article used for wiping, makeup, or the like, a wet sheet in which a sheet made of a nonwoven fabric is impregnated with a liquid component such as water or alcohol has been known. A wet sheet storage container for storing a wet sheet in a state of being wound in a roll shape has been widely known, for example, in which a container body is configured to be separatable vertically, and a extracting part of a wet sheet made up of a slit or a small hole is formed on an upper surface of the upper container body (hereinafter, a lid body).

In the wet sheet storage container of the related art, a male thread part is formed on an outer circumferential surface of an upper end part of a lower container body (hereinafter, a container body), and a male thread part to be screwed with a female thread part is formed on an inner circumferential surface of the lid body, (see, for example, Patent Document 1).

Patent Document 1: Japanese Patent No. 3621920

SUMMARY

However, in the wet sheet storage container of the related art, since a height of the thread part is designed so as not to idle when installing the lid body on the container body while rotating, in a case where the lid body is pushed into the container body from the upper side to fit with each other at the time of manufacturing, there is a problem that it is difficult to fit the lid body and installation property is bad.

On the other hand, in a case where a height of the thread part is designed to be constantly low with emphasis on the installation property at the time of manufacturing, there is a problem that the lid body is liable to idle when installing the lid body on the container body while rotating.

An object of the invention is to provide a wet sheet storage container capable of improving the installation property of the lid body from the upper side at the time of manufacturing, while suppressing idling of the lid body when installing the lid body while rotating.

The invention described in claim 1 is made to achieve the above object.

There is provided a wet sheet storage container including a container body which has an opening part and stores a wet sheet in a state of being wound in a roll shape from the opening part; and a lid body which is attached to the container body to open and close the opening and has an extracting part for extracting the wet sheet to outside on an upper surface, in which a plurality of male thread parts for screwing the lid body along a circumferential direction is formed on an outer circumferential surface of an upper end part of the container body, a plurality of female thread parts to be screwed with the male thread parts is formed on an inner circumferential surface of the lid body, the male thread parts include a base end part formed on an upstream side in a rotating direction of the lid body when the lid body is installed, and a tip end part formed on a downstream side in the rotating direction of the lid body, and a height of the tip end part is formed to be higher than a height of the base end part.

According to the invention described in claim 2, in the wet sheet storage container described in claim 1, the male thread parts are formed such that a length of the tip end part is shorter than a length of the base end part.

According to the invention described in claim 3, in the wet sheet storage container described in claim 1 or 2, when the height of the tip end part is defined as a and the height of the base end part is defined as b, the male thread parts are formed such that a ratio of the height of the tip end part to the height of the base end part falls within a range of $0.7<b/a<1.0$.

According to the invention described in claim 4, in the wet sheet storage container described in any one of claims 1 to 3, when the length of the tip end part is defined as c and the length of the base end part is defined as d, the male thread parts are formed such that a ratio of the length of the tip end part to the length of the base end part falls within a range of $1.0<d/c<5.0$ According to the invention described in claim 5, in the wet sheet storage container described in any one of claims 1 to 4, an inclined part inclined inward toward the base end part is provided at an end part of the tip end part on the base end part side.

According to the invention, it is possible to improve the installation property of the lid body from the upper side at the time of manufacturing, while suppressing idling of the lid body when installing the lid body while rotating.

DETAILED DESCRIPTION

Hereinafter, embodiments of the invention will be described with reference to the drawings.

First, a configuration will be described.

Figure 1:
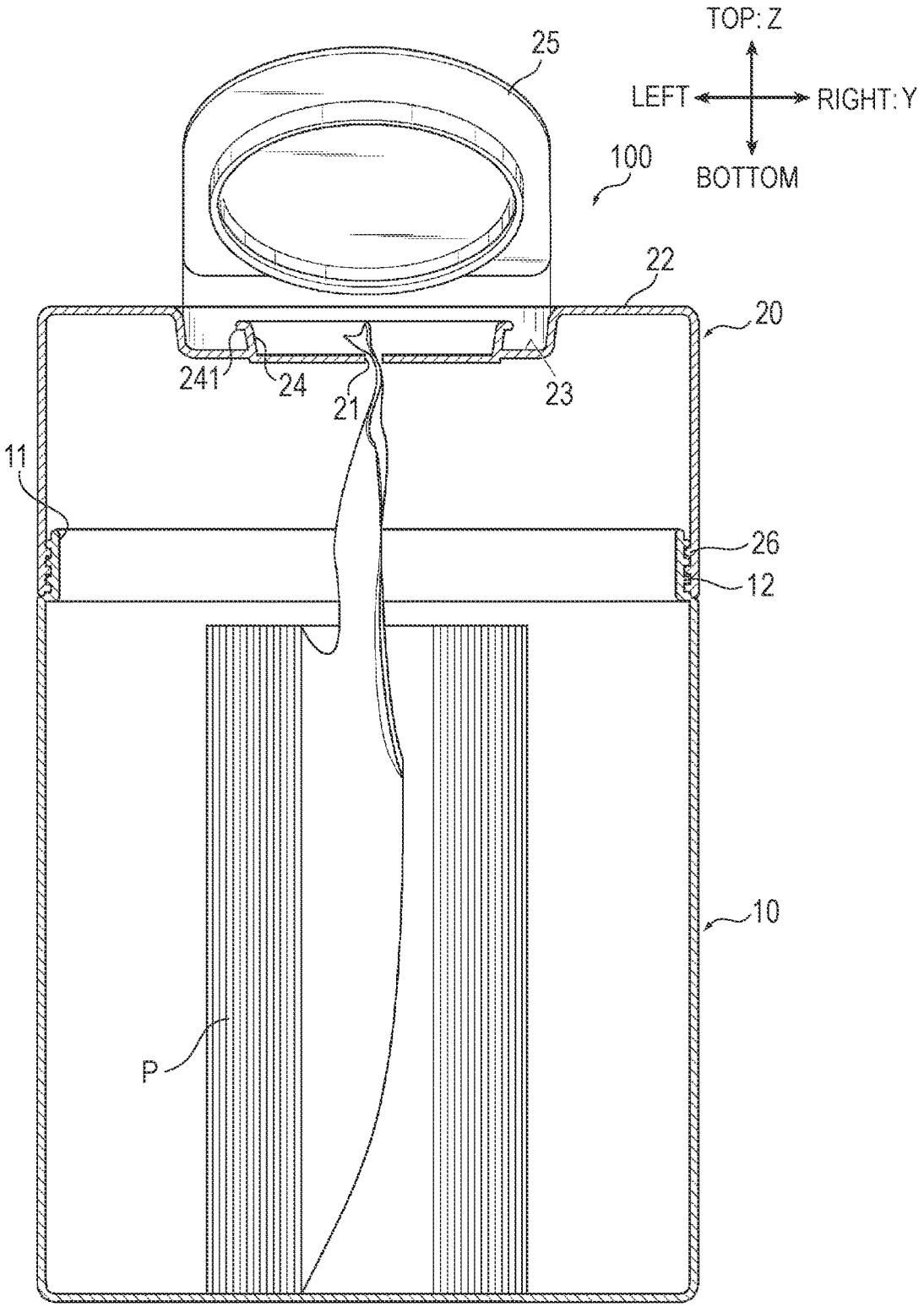
FIG. 1 is a cross-sectional view of a wet sheet storage container according to an embodiment as viewed from a front.
Figure 2:
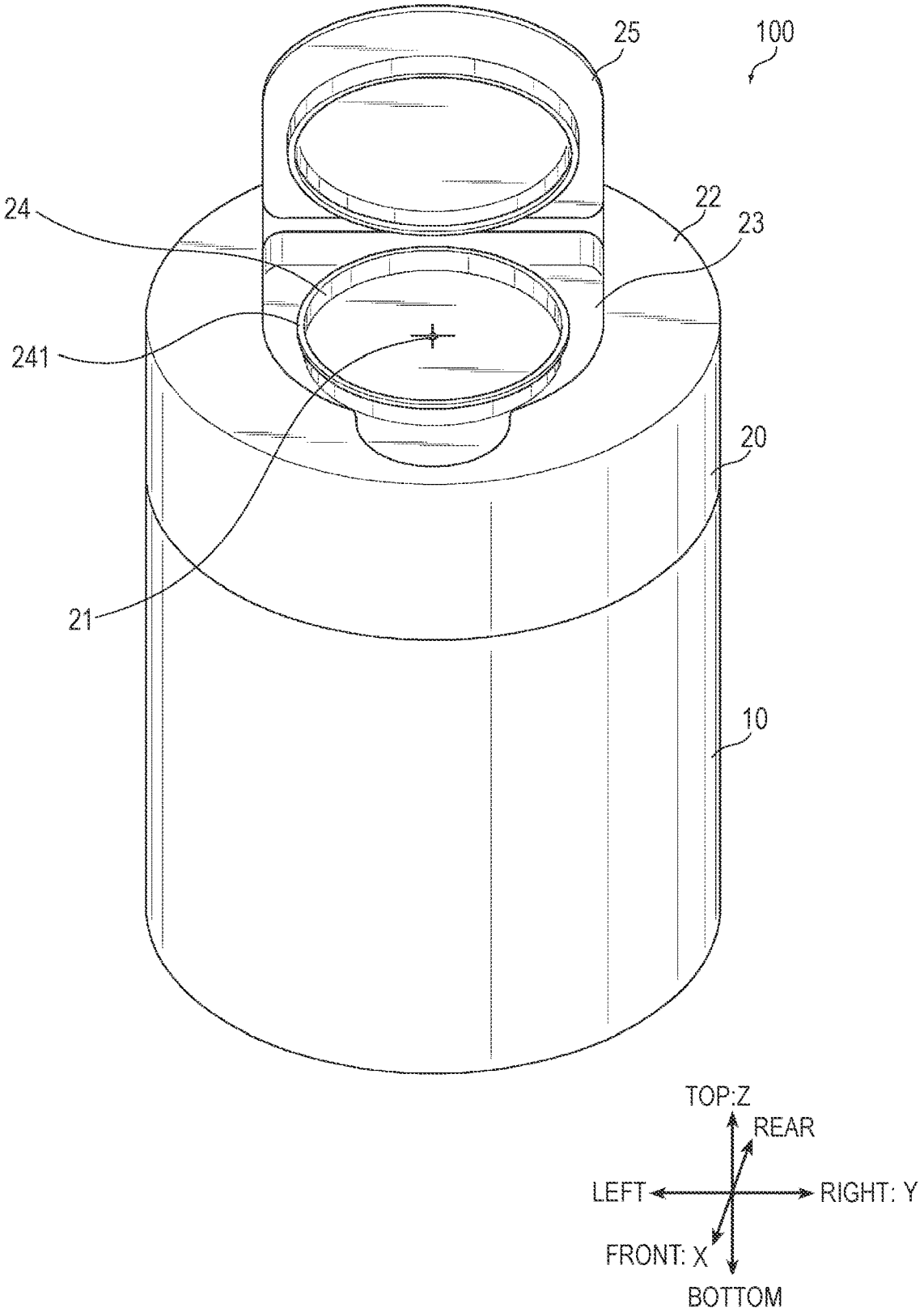
FIG. 2 is an external perspective view of the wet sheet storage container of the embodiment as viewed from a front upper side.

As illustrated in FIGS. 1 and 2, a wet sheet storage container (hereinafter, a storage container) 100 according to the embodiment is configured to include, for example, a bottle-shaped container body 10 that has an opening part 11 and stores a wet sheet P in a state of being wound in a roll shape from the opening part 11, and a lid body 20 which is detachably attached to the container body 10 to open and close the opening part 11 and has an extracting part 21 for extracting the wet sheet P to the outside on the upper surface.

Perforations are provided at regular intervals in a longitudinal direction on the wet sheet P wound in a roll shape to be stored in the storage container 100, such that the wet sheet P of a size separated along the perforations is used by users.

Further, in the following description, a front-back direction of the storage container 100 is defined as an X-axis direction, a side on which a small lid 25 is supported by the lid body 20 is defined as a rear side, and an opposite side thereof is defined as a front side. Further, in the front view, a horizontal direction (a width direction) is defined as a Y-axis direction and a vertical direction is defined as a Z-axis direction.

Figure 3:
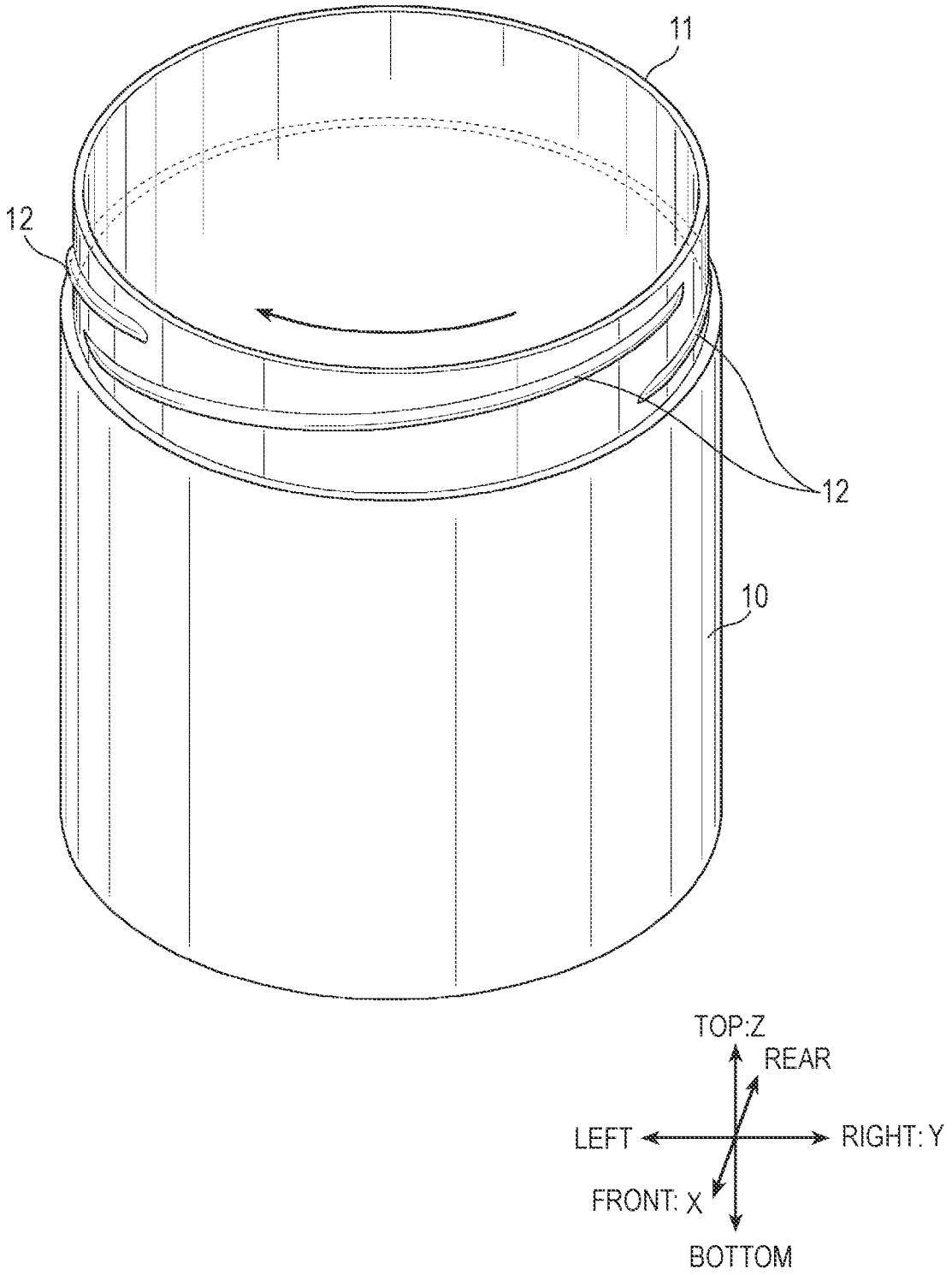
FIG. 3 is an external perspective view of a container body as viewed from the front upper side.
Figure 4:
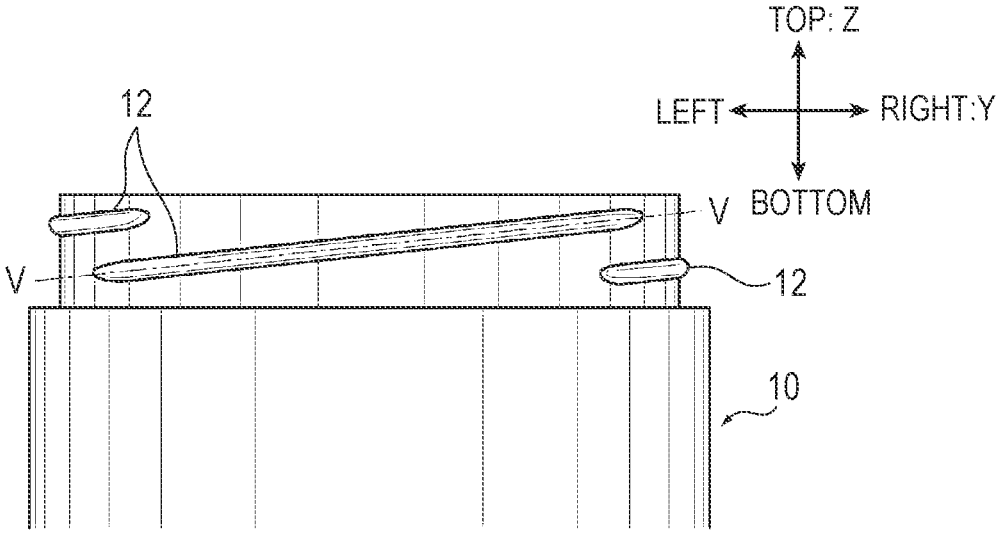
FIG. 4 is an external front view of the container body as viewed from the front.

The container body 10 has a substantially cylindrical shape that is substantially constant from a bottom part to a vicinity of an upper end part, and has the opening part 11 which is largely opened on the upper surface. Further, as illustrated in FIGS. 3 and 4, on the outer circumferential surface of the upper end part of the container body 10, a plurality (three in the drawings) of male thread parts 12 is intermittently formed along a circumferential direction.

Since the container body 10 has a cylindrical shape, and is able to dispose and store the roll-shaped wet sheet P at a substantially concentric position. Further, the wet sheet P is configured to draw out a piece of paper from the center side of the roll.

The container body 10 is integrally formed by injection molding, two-color molding, blow molding, or the like, using polyethylene (PE), polypropylene (PP), polyethylene terephthalate (PET), acrylonitrile butadiene styrene (ABS) resin or the like.

The lid body 20 has a cylindrical shape having a length shorter than the container body 10, an upper end side thereof is closed by a top surface part 22, and a lower end part thereof is open. Further, an outer diameter of the lid body 20 is substantially equal to an outer diameter of the container body 10, and a female thread part 26 to be screwed with the male thread part 12 of the container body 10 is intermittently provided on the inner circumferential surface of the lid body in the same number as the male thread part 12. By intermittently forming the plurality of male thread parts 12 and female thread parts 26, the lid body 20 can be pushed and fitted into the container body 10 from the upper side at the time of manufacturing. The lid body 20 is detachable from the upper end part of the container body 10 by the female thread part 26.

Therefore, in a state in which the lid body 20 is detached from the container body 10, it is possible to fill the interior of the container body 10 with the wet sheet P. In a state in which the lid body 20 is attached to the container body 10, the roll of the wet sheet P of the interior can be held so as not to go out.

The lid body 20 is integrally formed by, for example, the injection molding, the two-color molding, the blow molding, or the like, using PE, PP, PET, ABS resin or the like.

A recessed part 23 is formed at a center part of the top surface part 22 of the lid body 20, and a small lid 25 is attached to the top surface part 22 so as to be fitted to the recessed part 23.

Further, a cylindrical part 24 is erected at a center part of the recessed part 23, and the inside thereof vertically penetrates to form an extracting part 21. A flange-shaped locking part 241 protruding outward is formed at the upper end of the cylindrical part 24, and it is possible to lock the flange-shaped locking part 241 when the small lid 25 is closed.

Here, the extracting part 21 is for extracting the wet sheet P inside in a state in which the lid body 20 is attached to the container body 10.

For example, the extracting part 21 is formed by a cross-shaped cut in a plan view, and when the wet sheet P passes through its center upward, the extracting part 21 appropriately imparts sliding resistance to the wet sheet P. As a result, when the wet sheet P is used, the sliding resistance acts on the wet sheet P to promote the separation from the perforations, and the tip end part of the next wet sheet P is held in the state of being sandwiched by the extracting part 21. Thus, the wet sheet P is prevented from returning to the container body 10, and the next wet sheet P can be immediately used.

The extracting part 21 is opened and closed by rotation of the small lid 25 about the Y-axis. The small lid 25 is provided with a hinge part (not illustrated) that allows the small lid 25 to be bent along the Y-axis direction in the vicinity of its rear end part, and the small lid 25 is fitted to the recessed part 23 and is erected from a state of closing the extracting part 21 and can rotate to a state in which the extracting part 21 is opened. Further, the small lid 25 is maintained in a normally closed state, except that it is brought into an open state when the wet sheet P is extracted.

Next, the configuration of the male thread part 12 formed in the container body 10 will be described with reference to FIGS. 3 to 5. Further, an arrow M in FIG. 3 indicates a rotating direction of the lid body 20 at the time of installing, while rotating the lid body 20.

Figure 5:
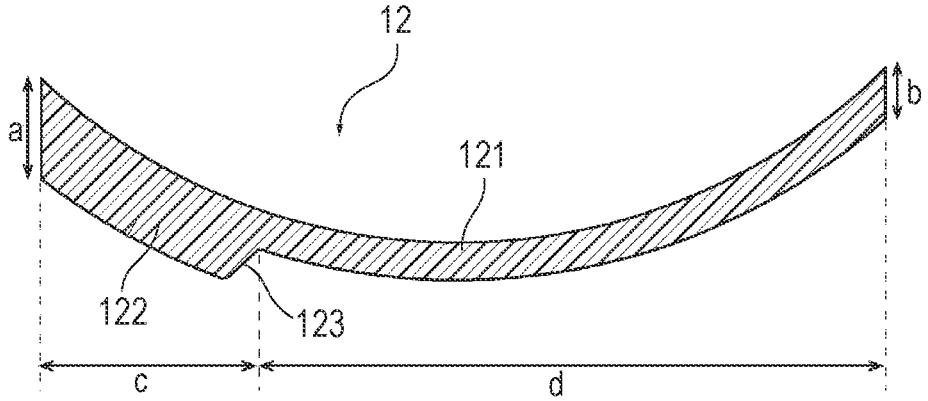
FIG. 5 is a cross-sectional view of a male thread part taken along a line V-V in FIG. 4.

As illustrated in FIG. 5, the male thread part 12 is configured to include a base end part 121 formed on an upstream side in the rotating direction of the lid body 20, and a tip end part 122 formed on a downstream side in the rotating direction of the lid body 20.

Each of the base end part 121 and the tip end part 122 has a constant height. A height a of the tip end part 122 is formed to be higher than a height b of the base end part 121. By making the height a of the tip end part 122 relatively high in this way, since it is possible to restrict the rotation of the lid body 20 at the time of installing, while rotating the lid body 20, idling of the lid body 20 can be suppressed.

In addition, a length c of the tip end part 122 is formed to be shorter than a length d of the base end part 121. By making the length c of the tip end part 122 relatively short in this way, since it is possible to reduce the frictional resistance caused by the contact with the tip end part 122 when installing the lid body 20 from the upper side at the time of manufacturing, it is possible to improve the installation property of the lid body 20.

Further, an inclined part 123 inclined inward (the container body 10 side) toward the base end part 121 is provided at the end part of the tip end part 122 on the side of the base end part 121. By providing the inclined part 123 in the tip end part 122 as described above, since it is possible to reduce the frictional resistance caused by the contact with the tip end part 122 when installing the lid body 20 from the upper side at the time of manufacturing, the installation property of the lid body 20 can be improved.

Examples

Next, the results of evaluating a correlation between the configuration of the male thread part 12 and installation property (ease of installing) and fitting property (difficulty in idling) at the time of installing the lid body 20 will be described using Tables 1 and 2. Table 1 shows an evaluation result of an comparative example (Comparative Example 1)

in which the height of the tip end part 122 of the male thread part 12 is the same as the height of the base end part 121, and an evaluation result of each example (Examples 1 to 4) in which the height of the tip end part 122 of the male thread part 12 is different from the height of the base end part 121. Table 2 shows evaluation results of the respective examples (Examples 5 to 9) in which lengths (ratios) of the tip end part 122 and the base end part 121 of the male thread part 12 are different from each other.

Further, Tables 1 and 2 show results which use the lid body 20 having the height of the female thread part 26 of 1.0 mm, and the container body 10 having the height of the base end part 121 of the male thread part 12 of 1.5 mm.

First, the evaluation results of Table 1 are shown. Further, Table 1 shows the results which use the tip end part 122 of the male thread part 12 having a length of 4.0 mm and the base end part 121 having a length of 8.0 mm.

TABLE 1

| | Height of tip end part [mm] | Height of base end part [mm] | Height difference [mm] | Height ratio | Installation property | Fitting property |
|---|---|---|---|---|---|---|
| Example 1 | 1.7 | 1.5 | 0.2 | 0.882 | ⊙ | ○ |
| Example 2 | 1.8 | 1.5 | 0.3 | 0.833 | ⊙ | ○ |
| Example 3 | 2.1 | 1.5 | 0.6 | 0.714 | ○ | ○ |
| Example 4 | 2.225 | 1.5 | 0.725 | 0.674 | Δ | ⊙ |
| Comparative Example 1 | 1.5 | 1.5 | 0.0 | 1.000 | ⊙ | X |

[Evaluation on Installation Property]

The evaluation was carried out in the following four stages:

⊙: It is possible to ideally install

○: It is possible to install without problems

Δ: Although there is a slight problem, there is no trouble in installing x: There is a problem with installing As shown in Table 1, in a case where the height of the tip end part 122 of the male thread part 12 is 2.225 mm (Example 4), although there is a slight problem, there is no trouble in installing. This is because, in a case where the height of the tip end part 122 of the male thread part 12 is set to 2.1 mm, although the lid body 20 is likely to come into contact with the tip end part 122 when installing the lid body 20 from the upper side at the time of manufacturing, the frictional resistance due to contact with the tip end part 122 is within an allowable range.

Further, in a case where the height of the tip end part 122 of the male thread part 12 is 1.5 mm to 2.1 mm (Comparative Example 1, and Examples 1 to 3), it is possible to install the lid body 20 without problems. In particular, in a case where the height of the tip end part 122 of the male thread part 12 is 1.5 mm to 1.8 mm (Comparative Example 1, and Examples 1 and 2), it is possible to ideally install the lid body 20. This is because, in a case where the height of the tip end part 122 of the male thread part 12 is set to 1.5 mm to 2.1 mm, and thus, a contact with the tip end part 122 can be reduced when the lid body 20 is installed from the upper side at the time of manufacturing, and thus, it is possible to sufficiently suppress frictional resistance due to contact with the tip end part 122 within an allowable range.

[Evaluation on Fitting Property]

The evaluation was carried out in four stages:

⊙: It is possible to ideally suppress idling

○: It is possible to suppress idling without problems

Δ: Although there is a slight problem, it is possible to suppress idling x: There is a problem with suppression of idling As shown in Table 1, in a case where the height of the tip end part 122 of the male thread part 12 is 1.5 mm (Comparative Example 1), there is a problem in suppression of idling. This is because, in a case where the height of the tip end part 122 of the male thread part 12 is 1.5 mm, the height of the tip end part 122 is insufficient and the female thread part 26 cannot be locked, and thus, it is not possible to restrict the rotation of the lid body 20 at the time of installing, while rotating the lid body 20.

On the other hand, in a case where the height of the tip end part 122 of the male thread part 12 is 1.7 mm to 2.225 mm (Examples 1 to 4), it is possible to suppress idling without problems. In particular, in a case where the height of the tip end part 122 of the male thread part 12 is 2.225 mm (Example 4), it is possible to ideally suppress idling. This is because, in a case where the height of the tip end part 122 of the male thread part 12 is set to 1.7 mm to 2.225 mm, the height of the tip end part 122 is sufficient and the female thread part 26 can be locked, and thus, it is possible to restrict the rotation of the lid body 20 at the time of installing, while rotating the lid body 20.

[Comprehensive Evaluation]

In a case where the height of the tip end part 122 of the male thread part 12 is 1.5 mm, that is, a ratio (b/a) of the height a of the tip end part 122 to the height b of the base end part 121 is 1.000 (Comparative Example 1), although there is no problem in installation property, there is a problem in fitting property.

In a case where the height of the tip end part 122 of the male thread part 12 is 2.225 mm, that is, the ratio (b/a) of the height a of the tip end part 122 to the height b of the base end part 121 is 0.674 (Example 4), although there is no problem in fitting property, there is a slight problem in installation property.

On the other hand, in a case where the height of the tip end part 122 of the male thread part 12 is 1.7 mm, that is, the ratio (b/a) of the height a of the tip end part 122 to the height b of the base end part 121 is 0.882 (Example 1), in a case where the height of the tip end part 122 is 1.8 mm, that is, the ratio (b/a) of the height a of the tip end part 122 to the height b of the base end part 121 is 0.833 (Example 2), and in a case in which the height of the tip end part 122 is 2.1 mm, that is, the ratio (b/a) of the height a of the tip end part 122 to the height b of the base end part 121 is 0.714 (Example 3), there are no problems in installation property and fitting property.

As described above, if the ratio (b/a) of the height a of the tip end part 122 to the height b of the base end part 121 is within the range of $0.7<b/a<1.0$, it is found that the installation property and the fitting property can obtain almost satisfactory results.

Next, the evaluation results of Table 2 are shown. Table 2 shows the results of using the male thread part 12 in which the height of the tip end part 122 is 1.7 mm and a height of the base end part 121 is 1.5 mm.

TABLE 2

| | Length in tip end part [mm] | Length in base end part [mm] | Length difference [mm] | Length ratio | Installation property | Fitting property |
|---|---|---|---|---|---|---|
| Example 5 | 2.0 | 10.0 | 8.0 | 5.0 | ⊙ | Δ |
| Example 6 | 4.0 | 8.0 | 4.0 | 2.0 | ○ | ○ |
| Example 7 | 6.0 | 6.0 | 0.0 | 1.0 | Δ | ○ |
| Example 8 | 8.0 | 4.0 | 4.0 | 0.5 | Δ | ○ |
| Example 9 | 10.0 | 2.0 | 8.0 | 0.2 | Δ | ○ |

[Evaluation on Installation Property]

The evaluation was carried out in four stages:

⊙: It is possible to ideally install

○: It is possible to install without problems

Δ: Although there is a slight problem, there is no trouble in installing x: There is a problem with installing As shown in Table 2, in a case where the length of the tip end part 122 of the male thread part 12 is 6.0 mm and the length of the base end part 121 is 6.0 mm (Example 7), in a case where the length of the tip end part 122 of the male thread part 12 is 8.0 mm and the length of the base end part 121 is 4.0 mm (Example 8), and in a case where the length of the tip end part 122 of the male thread part 12 is 10.0 mm and the length of the base end part 121 is 2.0 mm (Example 9), although there is a slight problem, there is no trouble in installing. This is because, in a case where the length of the tip end part 122 of the male thread part 12 is set to 6.0 mm to 10.0 mm (the length of the base end part 121 is set to 6.0 mm to 2.0 mm), although the contact area with the tip end part 122 increases when the lid body 20 is installed from the upper side at the time of manufacturing, the frictional resistance due to the contact with the tip end part 122 is within an allowable range.

On the other hand, in a case where the length of the tip end part 122 of the male thread part 12 is 2.0 mm and the length of the base end part 121 is 10.0 mm (Example 5), and in a case where the length of the tip end part 122 of the male thread part 12 is 4.0 mm and the length of the base end part 121 is 8.0 mm (Example 6), it is possible to install the lid body 20 without problems. In particular, in a case where the length of the tip end part 122 is 2.0 mm (Example 5), it is possible to ideally install the lid body 20. This is because, in a case where the length of the tip end part 122 of the male thread part 12 is set to 2.0 mm to 4.0 mm (the length of the base end part 121 is 10.0 mm to 8.0 mm), the contact area with the tip end part 122 can be narrowed when the lid body 20 is installed from the upper side at the time of manufacturing, and thus, it is possible to sufficiently suppress frictional resistance due to contact with the tip end part 122 within an allowable range.

[Evaluation on Fitting Property]

The evaluation was carried out in four stages:

⊙: It is possible to ideally suppress idling

○: It is possible to suppress idling without problems

Δ: Although there is a slight problem, it is possible to suppress idling x: There is a problem with suppression of idling As shown in Table 2, in a case where the length of the tip end part 122 of the male thread part 12 is 2.0 mm and the length of the base end part 121 is 10.0 mm (Example 5), although there is a slight problem, there is no hindrance in suppression of idling. This is because, in a case where the length of the tip end part 122 of the male thread part 12 is set to 2.0 mm (the length of the base end part 121 is set to 10.0 mm), even though the length of the tip end part 122 is not sufficient, the female thread part 26 can be locked, and thus, it is possible to restrict the rotation of the lid body 20 at the time of installing, while rotating the lid body 20.

Further, in a case where the length of the tip end part 122 of the male thread part 12 is 4.0 mm to 10.0 mm and the length of the base end part 121 is 8.0 mm to 2.0 mm (Examples 6 to 9), it is possible to suppress idling without problems. This is because, in a case where the length of the tip end part 122 of the male thread part 12 is set to 4.0 mm to 10.0 mm (the length of the base end part 121 is set to 8.0 mm to 2.0 mm), the length of the tip end part 122 is sufficient and the female thread part 26 can be locked, and thus, it is possible to restrict the rotation of the lid body 20 at the time of installing, while rotating the lid body 20.

[Comprehensive Evaluation]

In a case where the length of the tip end part 122 of the male thread part 12 is 2.0 mm and the length of the base end part 121 is 10.0 mm, that is, a ratio (d/c) of a length c of the tip end part 122 to a length d of the base end part 121 is 5.0 (Example 5), although there is no problem in installation property, there is a slight problem in the fitting property.

In a case where the length of the tip end part 122 of the male thread part 12 is 6.0 mm and the length of the base end part 121 is 6.0 mm, that is, the ratio (d/c) of the length c of the tip end part 122 to the length d of the base end part 121 is 1.0 (Example 7), in a case where the length of the tip end part 122 is 8.0 mm and the length of the base end part 121 is 4.0 mm, that is, the ratio (d/c) of the length c of the tip end part 122 to the length d of the base end part 121 is 0.5 (Example 8), and in a case where the length of the tip end part 122 is 10.0 mm and the length of the base end part 121 is 2.0 mm, that is, the ratio (d/c) of the length c of the tip end part 122 to the length d of the base end part 121 is 0.2 (Example 9), although there is no problem in fitting property, there is a slight problem in installation property.

On the other hand, in a case where the length of the tip end part 122 of the male thread part 12 is 4.0 mm and the length of the base end part 121 is 8.0 mm, that is, the ratio (d/c) of the length c of the tip end part 122 to the length d of the base end part 121 is 2.0 (Example 6), there are no problems in installation property and fitting property.

From the above, if the ratio (d/c) of the length c of the tip end part 122 and the length d of the base end part 121 is within the range of $1.0<d/c<5.0$, it is found that the installation property and the fitting property can obtain almost satisfactory results.

As described above, according to the storage container 100 of the embodiment, a plurality of male thread parts 12 for screwing the lid body 20 along the circumferential direction is provided on the outer circumferential surface of the upper end part of the container body 10, and a plurality of female thread parts 26 to be screwed onto the male thread part 12 is formed on the inner circumferential surface of the lid body 20. Further, the male thread part 12 includes a base end part 121 formed on the upstream side in the rotating direction of the lid body 20 when the lid body 20 is installed and a tip end part 122 formed on the downstream side in the rotating direction of the lid body 20, and the height of the tip end part 122 is formed to be higher than the height of the base end part 121.

Therefore, according to the storage container 100 of the embodiment, since the height of the tip end part 122 becomes relatively high and it is possible to restrict the rotation of the lid body 20 at the time of installing, while rotating the lid body 20, it is possible to suppress the idling of the lid body 20. In addition, since the height of the base end part 121 becomes relatively low and it is possible to reduce frictional resistance due to contact with the tip end part 122 when installing the lid body 20 from the upper side at the time of manufacturing, it is possible to improve the installation property of the lid body 20. Therefore, it is possible to improve the installation property of the lid body 20 from the upper side at the time of manufacturing, while suppressing the idling of the lid body 20 at the time of installing, while rotating the lid body 20.

In addition, according to the storage container 100 of the embodiment, the male thread part 12 is formed such that the length of the tip end part 122 becomes shorter than the length of the base end part 121.

Therefore, according to the storage container 100 of the embodiment, since the length of the tip end part 122 becomes relatively short and it is possible to reduce the frictional resistance due to contact with the tip end part 122 when installing the lid body 20 from the upper side at the time of manufacturing, the installation property of the lid body 20 can be improved.

Further, according to the storage container 100 according to the embodiment, the male thread part 12 is formed such that, when the height of the tip end part 122 is defined as a and the height of the base end part 121 is defined as b, the ratio of the height of the tip end part 122 to the height of the base end part 121 falls within the range of $0.7<b/a<1.0$.

Therefore, with the storage container 100 according to the embodiment, since it is possible to restrict the rotation of the lid body 20 at the time of installing, while rotating the lid body 20, while sufficiently suppressing the frictional resistance due to the contact with the tip end part 122 when installing the lid body 20 from the upper side at the time of manufacturing, it is possible to sufficiently secure both the installation property and the fitting property of the lid body 20.

Further, according to the storage container 100 according to the embodiment, the male thread part 12 is formed such that, when the length of the tip end part 122 is defined as c and the length of the base end part 121 is defined as d, a ratio of the length of the tip end part 122 to the length of the base end part 121 falls within the range of $1.0<d/c<5.0$.

Therefore, with the storage container 100 according to the embodiment, since it is possible to restrict the rotation of the lid body 20 at the time of installing, while rotating the lid body 20, while sufficiently suppressing the frictional resistance due to the contact with the tip end part 122 when installing the lid body 20 from the upper side at the time of manufacturing within an allowable range, it is possible to sufficiently secure both the installation property and the fitting property of the lid body 20.

Further, according to the storage container 100 of the embodiment, the inclined part 123 inclined inward toward the base end part 121 is provided at the end part of the tip end part 122 on the base end part 121 side.

Therefore, with the storage container 100 according to the embodiment, since it is possible to reduce the frictional resistance caused by the contact with the tip end part 122 when installing the lid body 20 from the upper side at the time of manufacturing, the installation property of the lid body 20 can be improved.

Although the invention has been specifically described based on the embodiments of the invention, the invention is not limited to the above-described embodiments, and can be modified within the scope that does not depart from the gist thereof.

For example, in the above-described embodiment, as illustrated in FIG. 5, by providing the inclined part 123 at the tip end part 122 of the male thread part 12, the tip end part 122 is formed in a substantially trapezoidal shape in a plan view. However, the invention is not limited thereto.

Figure 6A:
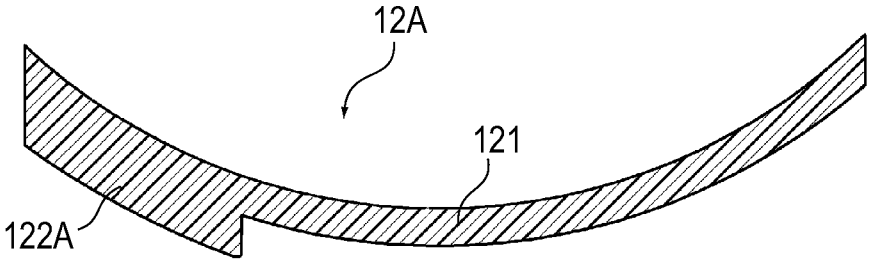
FIG. 6A is a cross-sectional view illustrating a modified example of the male thread part.

For example, as illustrated in FIG. 6A, the inclined part 123 may not be provided at a tip end part 122A of a male thread part 12A.

Figure 6B:
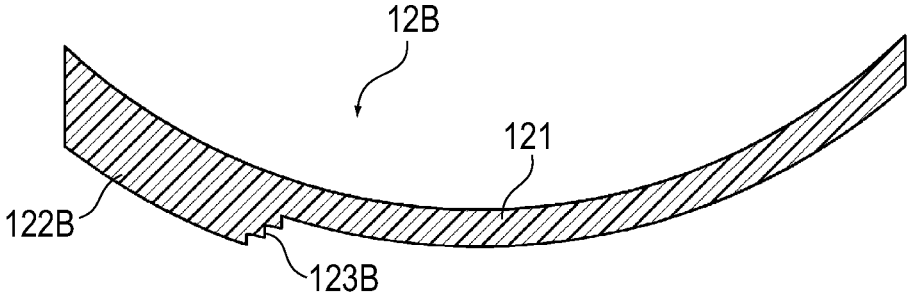
FIG. 6B is a cross-sectional view illustrating a modified example of the male thread part.

As illustrated in FIG. 6B, an inclined part 123B inclined in a stepwise manner toward the base end part 121 may be provided at an end part of a tip end part 122B of a male thread part 12B on the base end part 121 side.

Figure 6C:
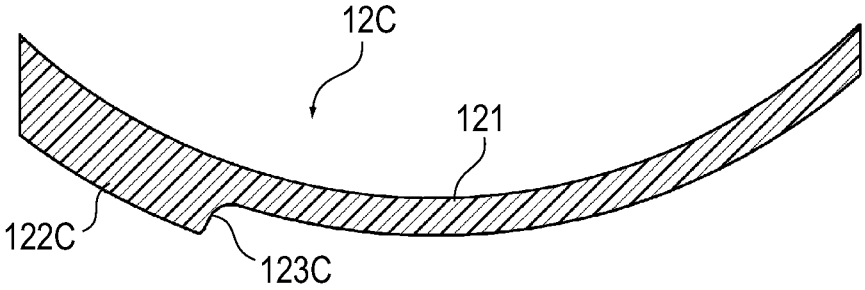
FIG. 6C is a cross-sectional view illustrating a modified example of the male thread part.

Further, as illustrated in FIG. 6C, an inclined part 123C inclined in a concave surface shape toward the base end part 121 may be provided at an end part of a tip end part 122C of a male thread part 12C on the base end part 121 side.

Figure 6D:
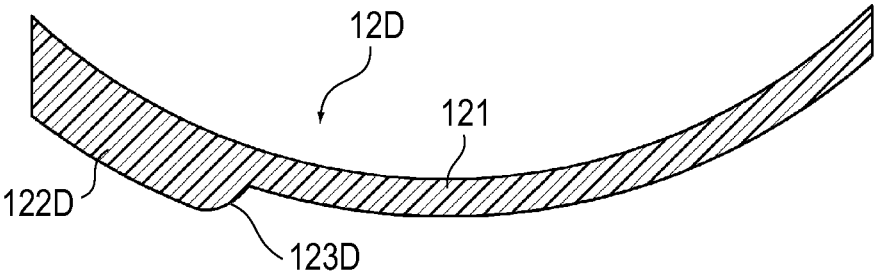
FIG. 6D is a cross-sectional view illustrating a modified example of the male thread part.

Further, as illustrated in FIG. 6D, an inclined part 123D inclined in a convex surface shape toward the base end part 121 may be provided at an end part of a tip end part 122D of a male thread part 12D on the base end part 121 side.

Besides, the detailed configuration of the storage container 100 can be appropriately changed within the scope that does not depart from the gist of the invention.

INDUSTRIAL APPLICABILITY

The invention can be applied to a wet sheet storage container.

The invention claimed is:

1. A wet sheet storage container comprising a container body which has an opening part and stores a wet sheet in a state of being wound in a roll shape from the opening part; and a lid body which is attached to the container body to open and close the opening and has an extracting part for extracting the wet sheet to outside on an upper surface, wherein a plurality of male thread parts for screwing the lid body along a circumferential direction is formed on an outer circumferential surface of an upper end part of the container body, a plurality of female thread parts to be screwed with the male thread parts is formed on an inner circumferential surface of the lid body, the male thread parts include a base end part formed on an upstream side in a rotating direction of the lid body when the lid body is installed, and a tip end part formed on a downstream side in the rotating direction of the lid body, and the tip end part is configured such that a height along the longitudinal direction of the container of the tip end part is formed to be higher than a height along the longitudinal direction of the container of the base end part, and a length along the circumferential direction of the container of the tip end part is shorter than a length along the circumferential direction of the container of the base end part.

2. The wet sheet storage container according to claim 1, wherein when the height along the longitudinal direction of the container of the tip end part is defined as a and the height along the longitudinal direction of the container of the base end part is defined as b, the male thread parts are formed such that a ratio of the height along the longitudinal direction of the container of the tip end part to the height along the longitudinal direction of the container of the base end part falls within a range of $0.7<b/a<1.0$.

3. The wet sheet storage container according to claim 1, wherein when the length along the circumferential direction of the container of the tip end part is defined as c and the length along the circumferential direction of the container of the base end part is defined as d, the male thread parts are formed such that a ratio of the length along the circumferential direction of the container of the tip end part to the length along the circumferential direction of the container of the base end part falls within a range of $1.0<d/c<5.0$.

4. The wet sheet storage container according to claim 1, wherein an inclined part having inward inclination toward the base end part and the container body is provided at an end part of the tip end part on the base end part side.

* * * * *